US006851933B2

(12) United States Patent
Cortez

(10) Patent No.: US 6,851,933 B2
(45) Date of Patent: Feb. 8, 2005

(54) ELECTRIC FAN ASSEMBLY AND FAN ASSEMBLY METHOD

(75) Inventor: Edward E. Cortez, Bartlett, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 10/372,374

(22) Filed: Feb. 22, 2003

(65) Prior Publication Data

US 2004/0165991 A1 Aug. 26, 2004

(51) Int. Cl.[7] ..... B63H 1/20
(52) U.S. Cl. ..... 416/204 R; 416/244 R; 416/246
(58) Field of Search ..... 416/204 R, 244 R, 416/246

(56) References Cited

U.S. PATENT DOCUMENTS 4,832,576 A * 5/1989 Deguchi et al. ..... 417/45
4,973,802 A * 11/1990 Wortham ..... 200/52 R
5,411,373 A * 5/1995 Chiu et al. ..... 416/246
5,558,501 A * 9/1996 Wang et al. ..... 416/244 R
5,965,067 A * 10/1999 Junkel et al. ..... 261/28
6,015,262 A * 1/2000 Huang ..... 416/100
6,183,204 B1 * 2/2001 Chang ..... 416/246

* cited by examiner

*Primary Examiner*—Hoang Nguyen
(74) *Attorney, Agent, or Firm*—Baker Donelson

(57) ABSTRACT

An electric fan assembly has structurally independent motor driven blades module, stand and shaft. The module and stand are mechanically assembled together by two mounting rings that are captured on the shaft. Electrical connections are also made during mechanical assembly with mateable connectors on internal cords.

17 Claims, 4 Drawing Sheets

ELECTRIC FAN ASSEMBLY AND FAN ASSEMBLY METHOD

TECHNICAL FIELD

This invention relates generally to electric fans, and more specifically to self standing electric fans that are packaged and sold in multiple units for later assembly.

BACKGROUND OF THE INVENTION

Self standing electric fans usually have motor driven fan blades mounted atop a pole or shaft that extends uprightly from a base or stand. Most of these have the motor driven fan blades constructed as a module that oscillates to distribute their air flow. Some have the module mounted to the shaft about four feet above the floor. Others have telescoping shafts so that the height of the blades module may be varied. Due to their length, especially those whose height is fixed, it is impractical to package, ship, store and sell these fans in a fully assembled configuration. Accordingly, they have often been designed, packaged and distributed in a broken-down configuration.

Heretofore, such self standing fans have been segmented for packaging into three discrete units, namely into a blades and motor module, a shaft and a base. This has been done by telescopically mounting the module and base to opposite ends of the shaft or pole with a tab and notch. Electric power is provided with an electric cord that extends from the module to an electric outlet as on a nearby wall.

The just described multi-unit, self standing fans have had certain pronounced problems. Foremost among these has been the electric cord that is draped from the fan motor. Not only has it been visually displeasing, but it has presented a trip hazard. It also has wiggled or bent back and forth somewhat as the fan oscillates. Attempts at extending the cord through the shaft have been impeded by UL safety regulations where the stand is collapsible since the cord gathers and extends inside the shaft. Also, running the cord through the shaft and base requires excessively large ports to accommodate the plug at the cord end.

Accordingly, it is seen that a need exists for a self standing electric fan assembly and fan assembly method that alleviates the just described problems. It is to the provision of such that the present invention is primarily directed.

SUMMARY OF THE INVENTION

In a preferred form of the invention an electric fan assembly comprises a stand having a base from which a leg upwardly extends that bears external threads and a leg electrical connector mounted adjacent the top of the leg from which electrical conductors extend. Fan blades coupled with an electric motor are mounted upon a hollow shaft from which motor upper electric conductors extend through the shaft to an upper connector configured to be releasibly connected with said base leg connector; and a mounting ring slidably mounted about the shaft that bears internal threads sized to be threaded onto the stand leg threads in releasibly mounting the shaft to the base.

In another preferred form of the invention an electric fan assembly comprises a stand bearing mounting threads and a subassembly bearing mounting threads that has a plurality of fan blades coupled with an electric motor. The assembly has a hollow rod to opposite ends of which the stand and the subassembly may be detachably mounted. Two mounting collars are slidably mounted to the rod that bear threads sized to be threaded upon the stand threads and the subassembly threads in securely mounting the subassembly and stand to the rod.

In yet another preferred form of the invention a method is provided for assembling a self standing electric fan that has a base with an electric connector from which a base cord extends, a hollow shaft, and an electric motor driven blade module from which an electric motor cord extends to a module connector. The method comprises the steps of passing the motor cord through the shaft, connecting the motor cord with the base cord, mounting the fan blade module to one end of the shaft, and mounting the base to the other end of the shaft.

DETAILED DESCRIPTION

Figure 1:
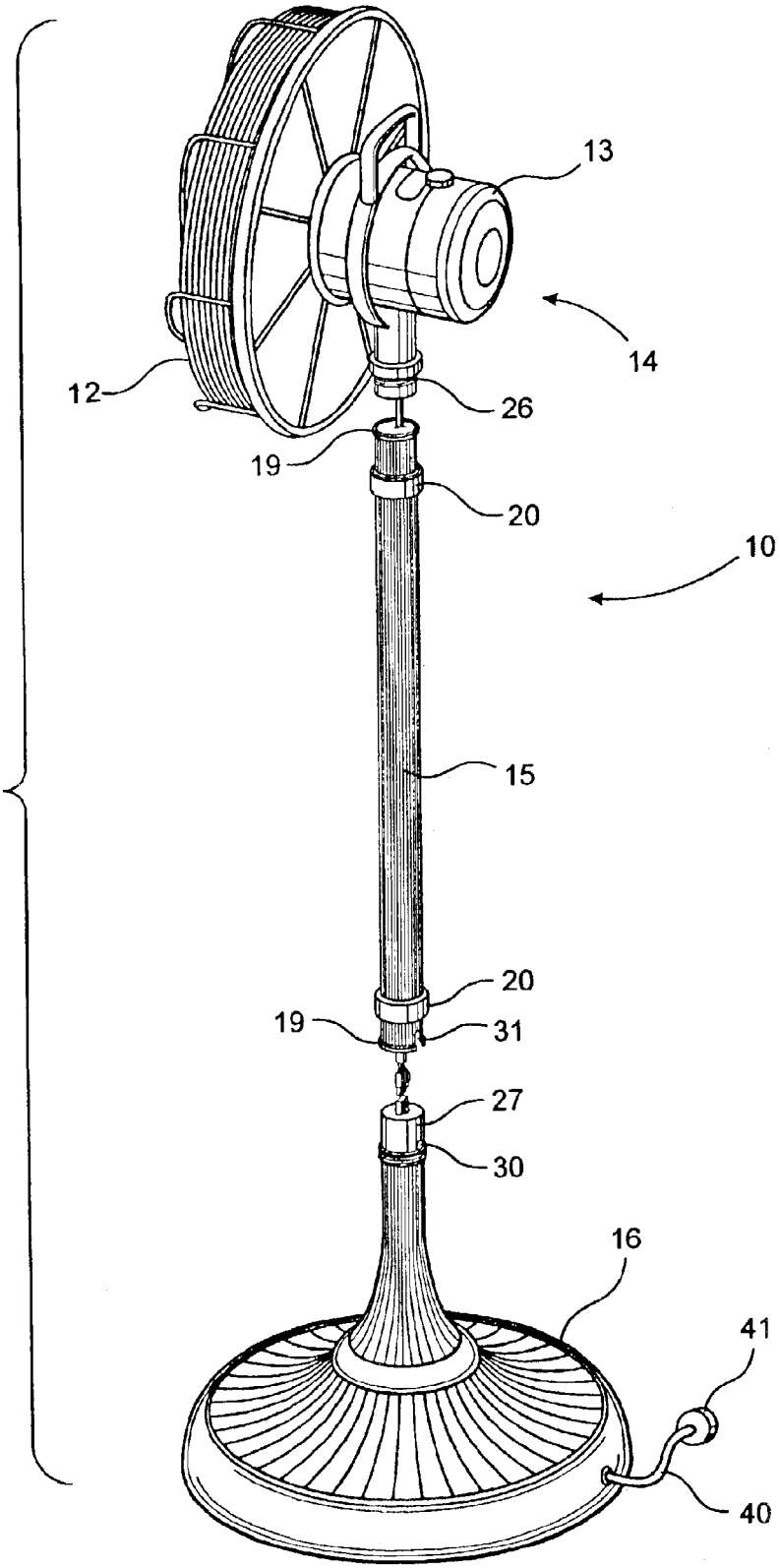
FIG. 1 is an exploded view, in perspective, of a self standing fan assembly that embodies principles of the invention in a preferred form.

With reference now in more detail to the drawing there is shown an electric fan assembly 10 that has a set of fan blades 11 mounted within a protective grill 12 that are rotatably driven by an electric motor shown generally at 13 in a conventional manner. Preferably the fan blade and motor module 14 is oscillatory although it need not be. The module is supported above a floor or the like by a decorative hollow, cylindrical shaft or pole 15 and base or stand 16. As best shown in FIG. 1, the fan assembly can be configured in a broken down configuration for packaging, shipping and storage into its three distinct units, namely its motor driven blades module 14, its shaft 15 and its base 16. For use it is easily reconfigured into an assembled configuration as hereafter described.

Figure 4:
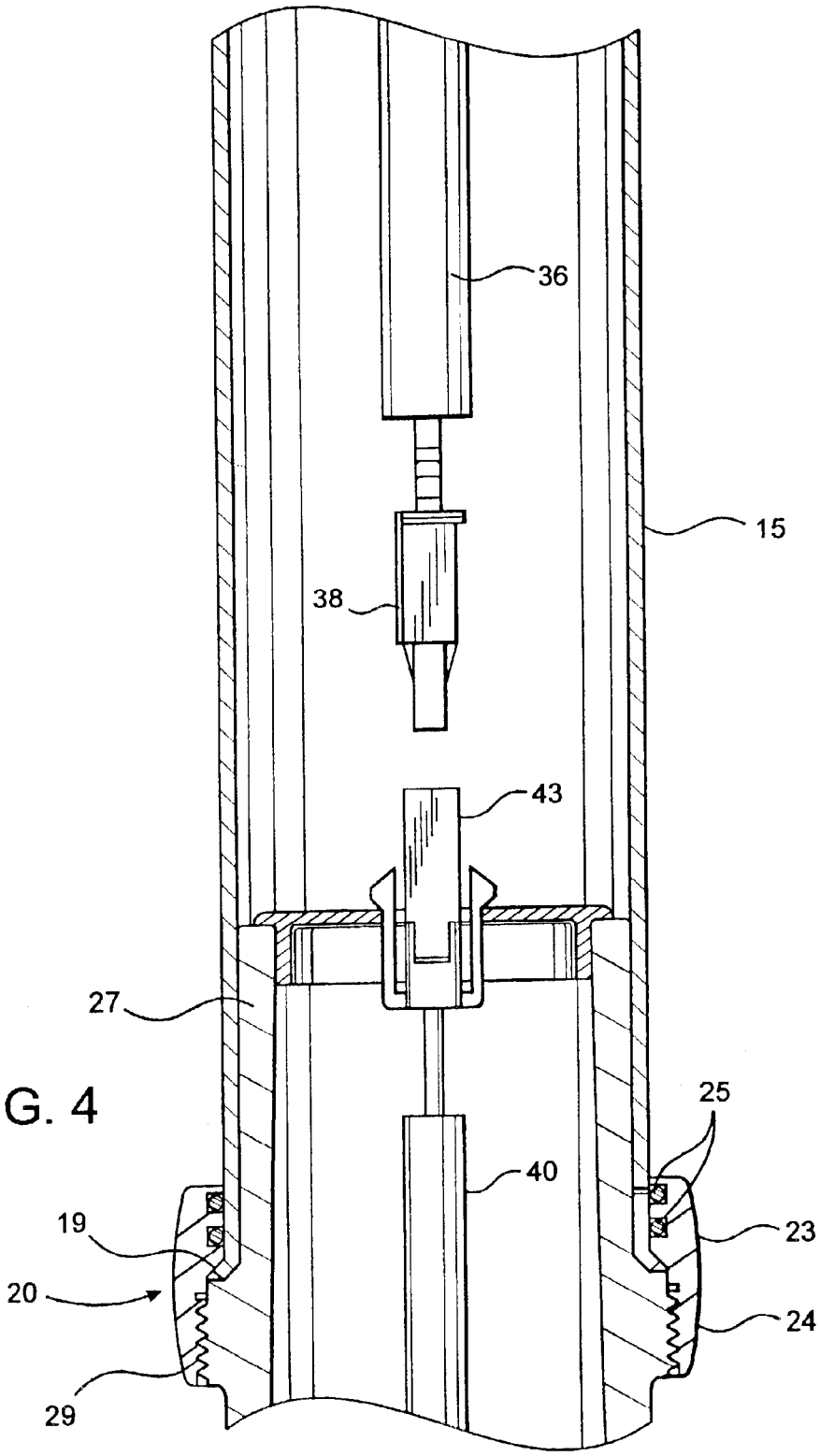
FIG. 4 is a cross-sectional view of part of the lower portion shown in FIG. 3 but shown in an assembled configuration.

The shaft 15 is packaged with two mounting collars or rings 20 slidably mounted on the shaft. These are mounted trapped or captured between end flanges 19 of the shaft 15 so that they cannot come off the shaft. As best shown in FIG. 4, each mounting collar 20 has one side 23 that has an inside diameter smaller than the outside maximum diameter of the shaft flanges 19 and another side 24 that has a threaded inside surface of an inside diameter greater than the maximum outside diameter of the shaft flanges 19. The two collars 20 are mounted to the shaft in opposite orientations so that their sides 23 are adjacent to one another. These sides 23 are each seen to have two annular inside grooves in which two O-rings 25 are seated flushly against the shaft 15.

Figure 2:
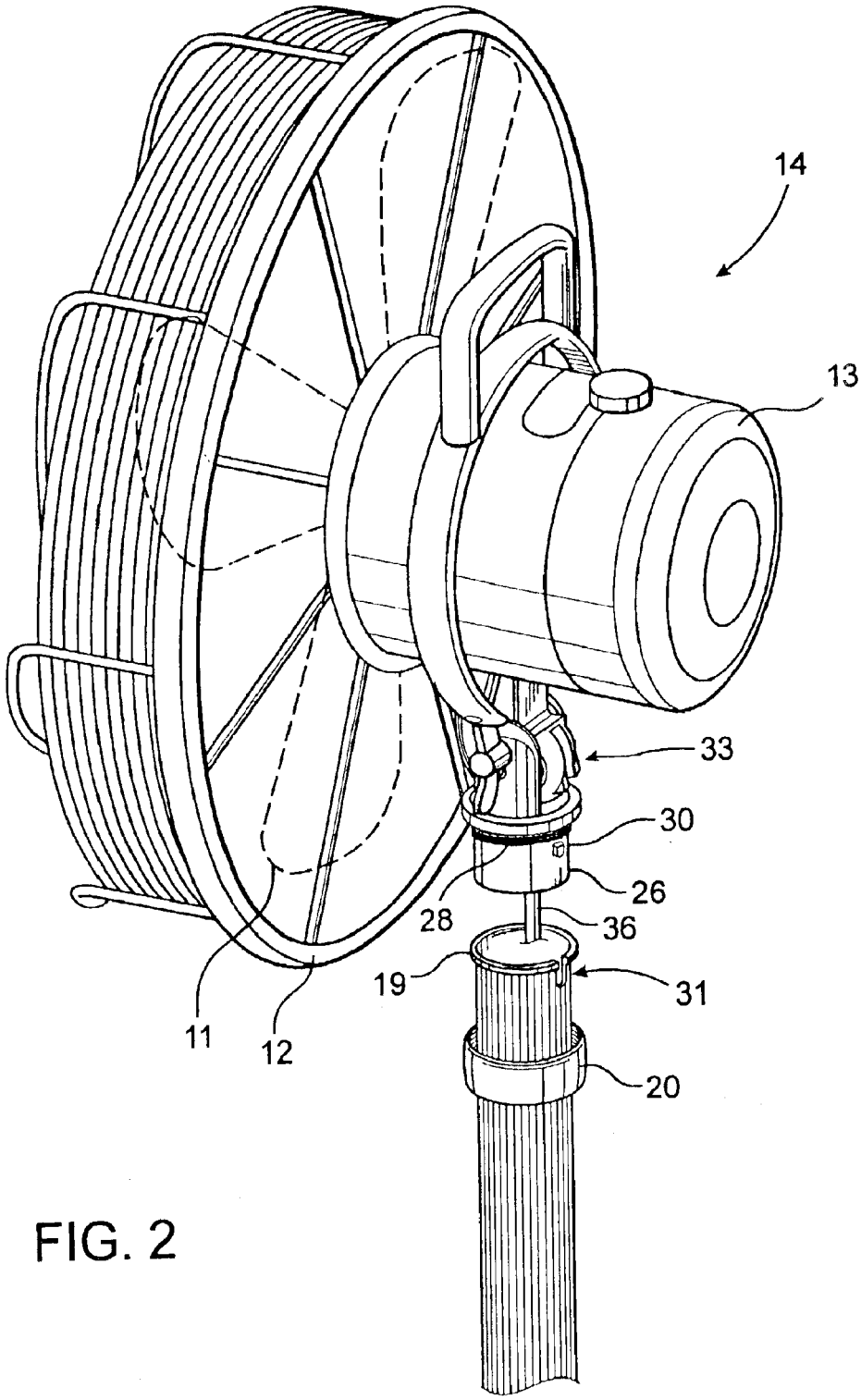
FIG. 2 is an enlarged view of an upper portion of the fan assembly.
Figure 3:
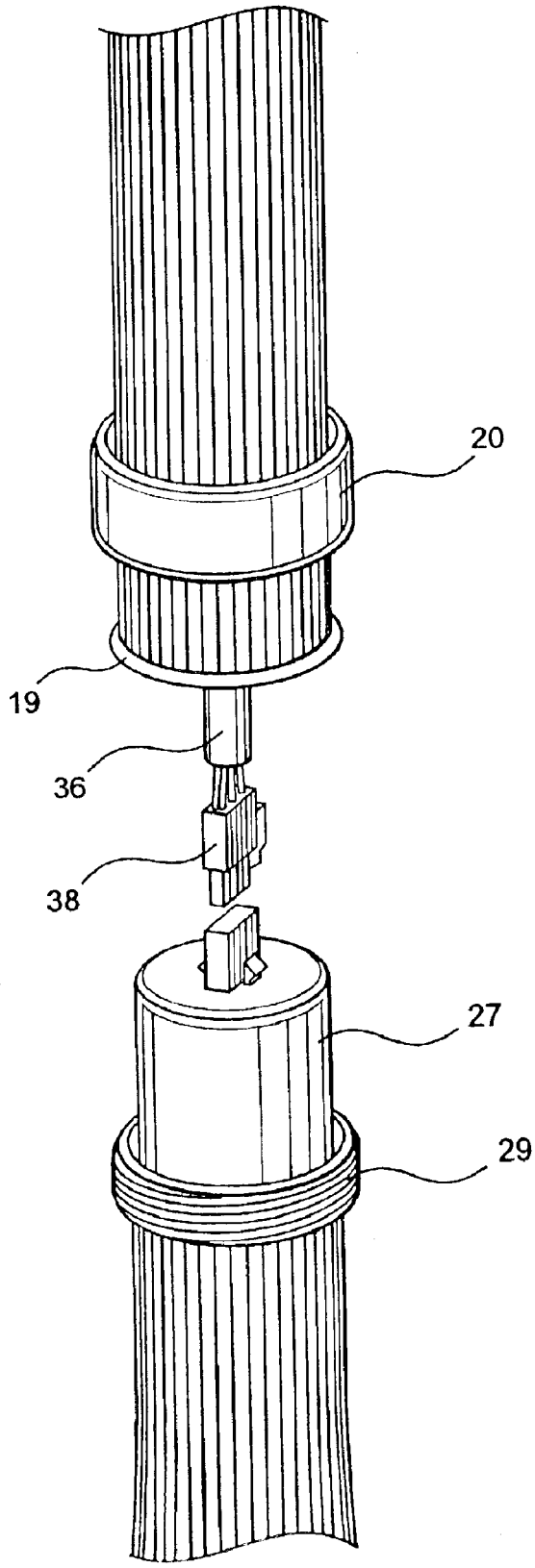
FIG. 3 is an enlarged view of a lower portion of the fan assembly.

Both the motor driven blades module 14 and the base 16 are seen to have two cylindrical necks 26 and 27, respectively, that bear external threads 28 and 29. These threads are located at some distance from the ends of the necks. As shown in FIG. 2, the neck 26 is formed with a raised tab 30 to mate with a notch 31 in the top flange 19 of the shaft. This is done as a means of locating the blades module with respect to the base which also has this type of tab feature. Finally it should be noted that the module neck 26 does not oscillate but supports a bearing 33 on which the rest of the module may oscillate.

An electric cord 36 extends from the motor 13 down through the module neck 26 and shaft 15 and is terminated at its bottom end with a male connector 38. Another electric cord 40 that is formed with a plug 41 at one end extends into the base 16 to a female connector 43 to which the connector 38 may be conventionally connected. Whereas the connector 38 is flexible, it being at the end of cord 36 that extends freely through the shaft 15, the connector 43 here is stationarily mounted atop the base neck 27.

As previously stated, the fan assembly may be packaged, transported, stored and sold in its broken down configuration for compactness. To assemble it the motor cord 36 is passed through the shaft 15 and connected with the base cord 40 by inserting connector 38 into connector 43. In doing this the blades module neck 26 is inserted into the top end of the shaft 15. After the connectors 38 and 43 are joined the base neck 27 is inserted into the bottom of the shaft. All this is facilitated by the cord 36 with its connector 38 being flexible and the base connector 43 inflexible whereby the connector 38 may be gripped and aligned with the connector 43 while the connector 43 remains put. As the assembly base and shaft are brought together the cord 38 is free to flex inside the shaft. The sequence of these just described assembly steps may of course be varied.

Once the blades module and base have been mounted to the shaft the assembly may be set upright. The two mounting collars may then be slid partially over the shaft flanges and then screwed onto the module thread 28 and the base threads 29 until tight and secure fits are made. In sliding the collars their O-rings prevent the decorative exterior surface of the shaft from marring.

It thus is seen that a self standing electric fan assembly and fan assembly method are now provided that alleviate problems associated with those of the past. The assembly is of simple and economic construction. Its method of assembly could hardly be easier.

Although the invention has been shown and described in its preferred form, it should be understood that many modifications may be made thereto without departure from its spirit and scope as set forth in the following claims.

What is claimed is:

1. An electric fan assembly comprising a stand having a base from which a leg upwardly extends that bears external threads and a leg electrical connector mounted adjacent the top of said leg from which electrical conductors extend; a plurality of fan blades coupled with an electric motor mounted upon a hollow shaft from which motor upper electric conductors extend through said shaft to an upper connector configured to be releasibly connected with said base leg connector; and a mounting ring slidably mounted about said shaft, said mounting ring having a first portion having a selected internal diameter and a sealing ring and a second portion having a select internal diameter larger than said first portion first select internal diameter and having internal threads for connecting with said external threads of said stand leg.

2. The electric fan assembly of claim 1 wherein said stand electrical conductors extend from said leg connector through said stand leg to a plug located externally of said stand base.

3. The electric fan assembly of claim 1 wherein said stand leg connector is rigidly mounted adjacent said stand top and wherein said upper connector is mounted to an end of said upper conductors that extend flexibly through said shaft.

4. The electric fan assembly of claim 1 wherein said shaft has a bottom end formed with a flange and wherein said mounting ring is slidably captured upon said shaft.

5. The electric fan assembly of claim 4 wherein said mounting ring has an upper portion with an inside diameter smaller than the maximum outside diameter of said shaft flange and has a lower portion formed with said internal threads that has an inside diameter greater than the maximum outside diameter of said shaft flange whereby the ring threads may be threaded onto the stand leg threads while the ring remains captured on the shaft.

6. The electric fan assembly of claim 1 wherein said stand leg has an upper end above said external threads with an outside surface sized to be telescopically slid into said shaft in mating engagement therewith.

7. The electric fan assembly of claim 1 wherein said upper unit motor is mounted atop a threaded neck that is detachably mounted to said shaft.

8. The electric fan assembly of claim 7 further comprising a second mounting ring slidably mounted about said shaft that bears internal threads sized to be threaded onto said neck threads in releasibly mounting said neck to said shaft.

9. The electric fan assembly of claim 8 wherein said shaft has a top end formed with a flange and wherein said second mounting ring is also slidably captured upon said shaft.

10. An electric fan assembly comprising a stand bearing mounting threads, a subassembly bearing mounting threads that has a plurality of fan blades coupled with an electric motor, and a hollow rod to opposite ends of which said stand and said subassembly may be detachably mounted, and two mounting collars slidably mounted on said rod, one said mounting collar having a first portion having a selected internal diameter and a second portion having a select internal diameter larger than said first portion first select internal diameter and having internal threads for connecting with said external threads of said stand mounting threads, and one said mounting ring having a first portion having a selected internal diameter and a sealing ring and a second portion having a select internal diameter larger than said first portion first select internal diameter and having internal threads for connecting with said external threads of said subassembly bearing mounting threads.

11. The electric fan assembly of claim 10 wherein each end of said rod is formed with a flange and wherein said two mounting collars are slidably mounted upon said rod captured between said two rod ends flanges.

12. The electric fan assembly of claim 11 wherein said two mounting collars have side portions adjacent each other that have an inside diameter smaller than said rod flanges and have side portions distal each other with an inside surface greater than said rod flanges and which bear said threads.

13. The electric fan assembly of claim 10 wherein said rod has a length and wherein said subassembly has an electric cord electrically connected to said motor of a length greater than said rod length, and wherein said stand has an electric cord that extends from a plug on one end to another end that is adapted to be electrically connected to said subassembly cord.

14. The electric fan assembly of claim 13 wherein an end of said stand cord and an end of said subassembly cord are formed with mateable connectors.

15. The electric fan assembly of claim 13 wherein said stand has a leg which said stand cord connector is rigidly mounted, and wherein said subassembly cord extends loosely through said rod whereby it may be manually gripped and aligned with said stand connector in joining the stand and subassembly connectors together.

16. A method of assembling a self standing electric fan that has a base with an electric connector from which a base cord extends, a hollow shaft having external mounting threads, and an electric motor driven fan blade module from which an electric motor cord extends to a module connector, and with the method comprising the steps of (a) passing the motor cord through the shaft, (b) connecting the motor cord with the base cord, (c) mounting the fan blade module to one end of the shaft, and (d) mounting the base to the other end of the shaft through a mounting ring having a first portion having a selected internal diameter and a sealing ring and a second portion having a select internal diameter larger than the first portion first select internal diameter and having internal threads for connecting with the external threads of the hollow shaft.

17. The assembly method of claim 16 wherein steps (a), (b), (c) and (d) are performed in sequence.

* * * * *